United States Patent [19]

Martinelli et al.

[11] Patent Number: 5,007,941

[45] Date of Patent: Apr. 16, 1991

[54] PROCESS FOR DYEING LEATHER: AQUEOUS BATH CONTAINING MIXTURE OF CARBON BLACK AND ACID DYE, DIRECT DYE OR METAL COMPLEX DYE

[75] Inventors: Bruno Martinelli, Allschwil; Markus Ghezzi, Oberschwiller, both of Switzerland; Günter Streicher, Weil am Rhein, Fed. Rep. of Germany

[73] Assignee: Ciba-Geigy Corporation, Ardsley, N.Y.

[21] Appl. No.: 454,499

[22] Filed: Dec. 21, 1989

[30] Foreign Application Priority Data

Jan. 2, 1989 [CH] Switzerland ..... 2/89

[51] Int. Cl.[5] ..... D06P 1/30

[52] U.S. Cl. ..... 8/436; 8/437; 8/638; 8/662; 8/681; 8/683; 8/685; 8/687; 8/916

[58] Field of Search ..... 8/436, 437, 681, 685

[56] References Cited

U.S. PATENT DOCUMENTS

| | | | |
|---|---|---|---|
| 4,710,198 | 12/1987 | Beffa et al. | 8/437 |
| 4,836,827 | 6/1989 | Puntemer | 8/437 |
| 4,914,764 | 4/1990 | Mast et al. | 8/436 |

FOREIGN PATENT DOCUMENTS

| | | |
|---|---|---|
| 46-002590 | 1/1971 | Japan . |
| 331077 | 4/1972 | U.S.S.R. . |
| 1164266 | 6/1985 | U.S.S.R. . |

OTHER PUBLICATIONS

Chem. Abstract, 93 221, 927e (1980).
Chem. Abstract, 97, 146,510r (1982).
Chem. Abstract, 107, 60, 955c (1987).

*Primary Examiner*—A. Lionel Clingman
*Attorney, Agent, or Firm*—George R. Dohmann; Edward McC. Roberts

[57] ABSTRACT

There is disclosed a process for dyeing leather by the exhaust process, which comprises treating leather with an aqueous liquor which contains a formulation comprising an anionic dye and a pigment. The leather dyeings obtained by this process have good allround fastness properties.

16 Claims, No Drawings

PROCESS FOR DYEING LEATHER: AQUEOUS BATH CONTAINING MIXTURE OF CARBON BLACK AND ACID DYE, DIRECT DYE OR METAL COMPLEX DYE

The present invention relates to a process for dyeing leather and to dye formulations suitable therefor.

It is already known in the art to coat leather with compositions which contain an anionic dye, an inorganic pigment, and a suitable binder, for example an acrylic resin. When applied, for example by spraying, the coloured formulation forms a film on the surface of the leather.

Surprisingly, it has now been found that formulations comprising substantially an inorganic dye and a pigment are excellently suited to dyeing leather by the exhaust process.

Accordingly, the invention relates to a process for dyeing leather by the exhaust process, which comprises treating leather with an aqueous liquor which contains a formulation comprising an anionic dye and a pigment.

Suitable anionic dyes are all dyes customarily used in leather dyeing. Preferred dyes are acid dyes and direct dyes, especially sulfonated monoazo, disazo and polyazo dyes as well as metal complex dyes.

The anionic dyes may be of any hue. Black dyes are preferred. This term will be understood as comprising for example, also dyes having a dark blue, bluish-grey or yellowish-, reddish- or greenish-black hue.

A group of particularly suitable anionic dyes is that of formula

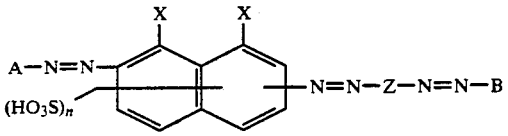

(1)

wherein one X is hydroxy and the other X is amino or hydrogen, A is an unsubstituted or a substituted phenyl or naphthyl radical, B is a phenyl or naphthyl radical containing at least one amino and/or hydroxyl group as well as further optional substituents, Z is a radical of formula

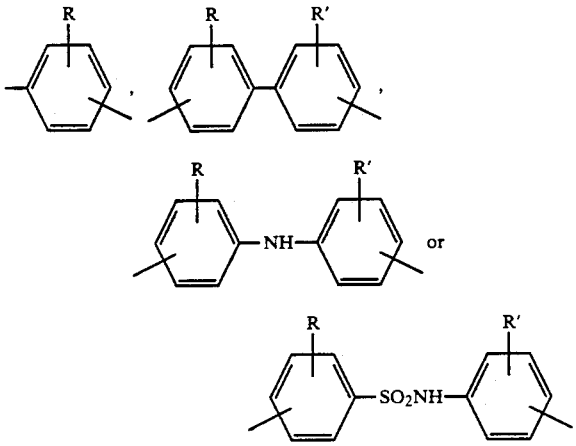

and R and R' are each independently of the other hydrogen, sulfo, $C_1$–$C_4$alkyl or $C_1$–$C_4$alkoxy, and n is 1 or 2.

The phenyl or naphthyl radical A may contain one or more identical or different substituents, for example $C_1$–$C_4$alkyl, which here and throughout this specification will generally be understood as meaning methyl, ethyl, n-propyl or isopropyl, or n-butyl, isobutyl, sec-butyl or tert-butyl; $C_1$–$C_4$alkoxy, which will generally be understood as meaning methoxy, ethoxy, n-propoxy or isopropoxy, or n-butoxy, isobutoxy, sec-butoxy or tert-butoxy; halogen, for example fluoro, bromo and, preferably, chloro; trifluoromethyl; $C_1$–$C_4$alkylsulfonyl, preferably methylsulfonyl or ethylsulfonyl; sulfamoyl, for example —$SO_2NH_2$, or N-monoalkylaminosulfonyl or N,N-dialkylaminosulfonyl, each containing 1 to 4 carbon atoms in the alkyl moiety or moieties, respectively; carbamoyl, for example —$CONH_2$, or N-monoalkylaminocarbonyl or N,N-dialkylaminocarbonyl, each containing 1 to 4 carbon atoms in the alkyl moiety or moieties, respectively; sulfo; nitro; cyano; carboxy; phenoxy.

Preferably A is phenyl or phenyl which is substituted by halogen, nitro, sulfo, $C_1$–$C_4$alkyl and/or $C_1$–$C_4$alkoxy.

In addition to amino and hydroxy, the phenyl or naphthyl radical B may carry further substituents, for example a N-monoalkylamino or N,N-dialkylamino radical, each containing 1 to 4 carbon atoms in the alkyl moiety or moieties, respectively, a phenylamino, o-, m- or p-methylphenylamino radical, or a benzoylamino, $C_1$–$C_4$alkanoylamino or carboxymethylamino radical, each unsubstituted or substituted, for example, by methyl, chloro or nitro, or one of the substituents cited previously for A.

Preferably B is a phenyl radical which carries a hydroxy or amino group and a further substituent selected from the group consisting of hydroxy, amino, phenylamino, o-, m- or p-methylphenylamino, $C_1$–$C_4$alkoxy and phenoxy.

Most preferably B is the radical of 1,3-dihydroxybenzene, 1,3-diaminobenzene or 3-aminophenol.

R and R' are each independently of the other preferably hydrogen, methyl, methoxy or sulfo.

Preferred radicals Z are:

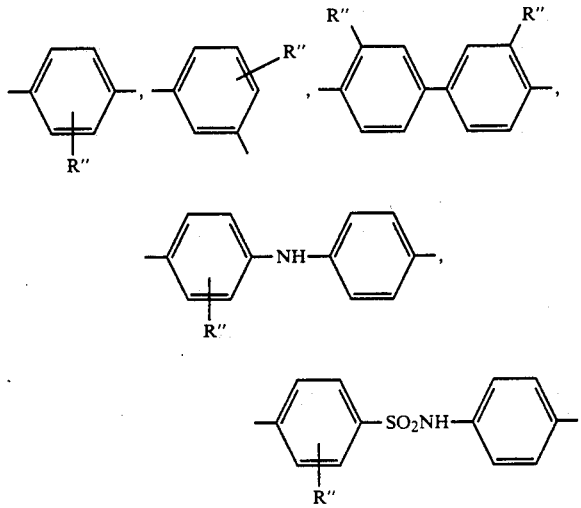

wherein R'' is, for example, hydrogen, methyl, methoxy or sulfo.

n is preferably 2.

The naphthol coupling component present in the anionic dyes of formula (1) is, for example, 2-amino-5-naphthol-7-sulfonic acid (I acid), 1-amino-8-naphthol-4,6-disulfonic acid (K acid) or, preferably, 1-amino-8-naphthol-3,6-disulfonic acid (H acid).

A particularly preferred group of anionic dyes for use in the process of this invention is that of formula

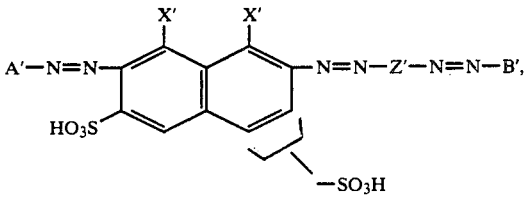

(1a)

wherein A' is phenyl or phenyl which is substituted by halogen, nitro, sulfo, $C_1$–$C_4$alkyl and/or $C_1$–$C_4$alkoxy, B' is a phenyl radical which carries a hydroxyl or amino group and a further substituent selected from the group consisting of hydroxy, amino, phenylamino, o-, m- or p-methylphenylamino, $C_1$–$C_4$alkoxy and phenoxy, Z' is a radical of formula

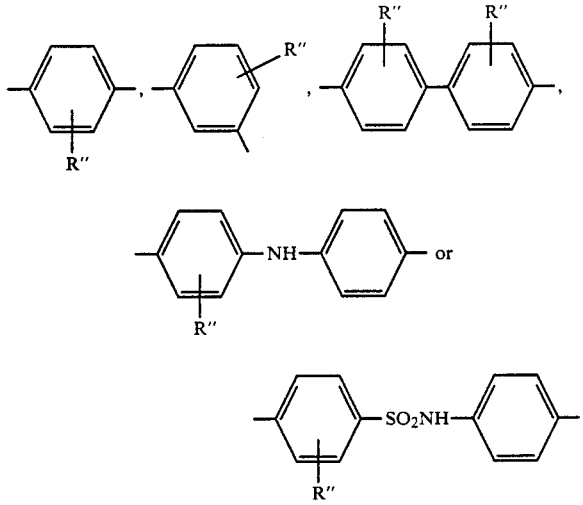

wherein R'' is as previously defined, and one X' is hydroxy and the other X' is amino.

Illustrative of especially preferred black dyes of formula (1) are

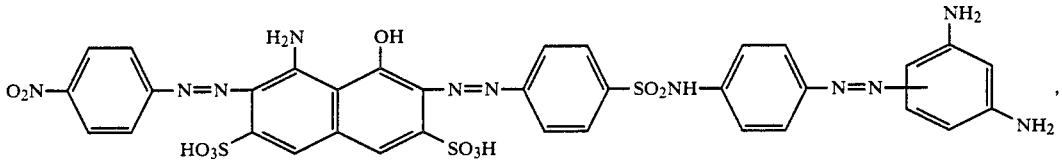

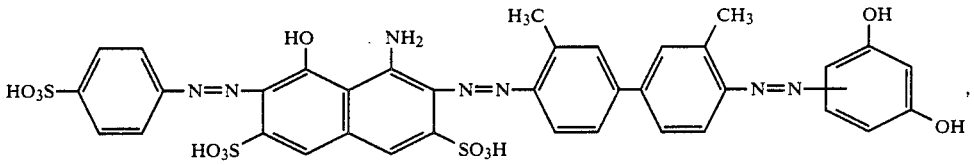

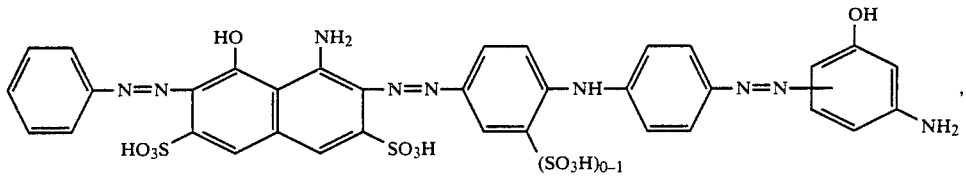

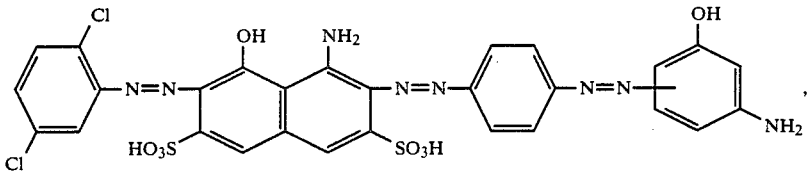

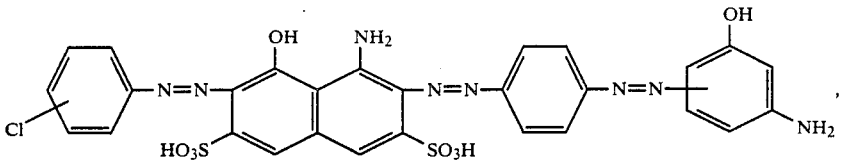

-continued

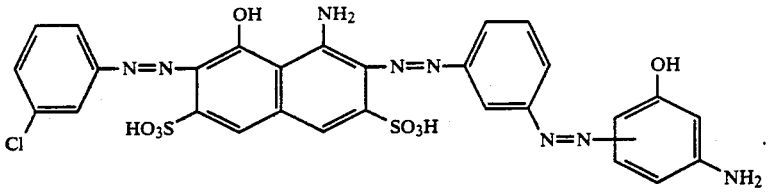

The dyes of formulae (1) and (1a) are known per se or can be obtained in a manner known per se.

A further group of suitable anionic dyes comprises metallised monoazo, disazo or polyazo dyes as well as azomethine dyes. The anionic character of these dyes may be imparted to them by metal complexing alone and/or by acid salt-forming substituents such as carboxylic acid groups, phosphonic acid groups and, in particular, by sulfonic acid groups. The 1:1 or 1:2 metal complex dyes are preferred. The 1:1 metal complexes contain preferably one or two sulfonic acid groups and typically a copper, nickel, iron or, especially, a chromium atom as heavy metal.

The 1:2 metal complex dyes contain a heavy metal atom as central atom, for example an iron, cobalt or, preferably, a chromium atom. Two complexing components are attached to the central metal atom, at least one of which components is a dye molecule; but preferably both components are dye molecules. Further, the two complexing dye molecules may be identical or different. The 1:2 metal complex dyes may contain, for example, two azomethine molecules, one azo and one azomethine dye or, preferably, two azo dyes, which dyes may be substituted by further arylazo and/or arylazoaryleneazo groups. Aryl will be understood as meaning here preferably benzene or naphthalene radicals which may be substituted, for example by nitro, sulfo, halogen, $C_1$–$C_4$alkyl or $C_1$–$C_4$alkoxy. The azo or azomethine dye molecules may contain water-solubilising groups, for example carbamoyl, $C_1$–$C_4$alkylsulfonyl or the acid groups mentioned above. Preferred 1:2 metal complexes are 1:2 cobalt or 1:2 chromium complexes of monoazo or disazo dyes which contain sulfonic acid groups.

The complex dyes which are particularly suitable for the process of this invention are in the form of the free acid of formula

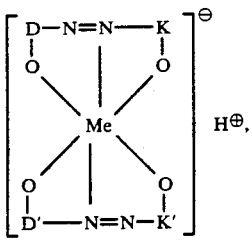

(2)

wherein D and D′ are each independently of the other a benzene or naphthalene radical which may or may not be further substituted and which carries a hydroxyl group ortho to the azo group, K and K′ are each independently of the other the radical of a coupling component of the benzene or naphthalene series which carries a hydroxyl group ortho to the azo group and which may or may not be further substituted, and Me is chromium or cobalt.

Suitable dyes of formula (2) are symmetrical as well as asymmetrical 1:2 metal complexes.

Me in formula (2) is preferably chromium.

Preferably D and D′ are each independently of the other a phenyl or naphthyl radical, each unsubstituted or substituted by sulfo, nitro, $C_1$–$C_4$alkylsulfonyl, $C_1$–$C_4$alkyl, halogen and/or phenylazo which may itself be substituted in the phenyl moiety by $C_1$–$C_4$alkyl, $C_1$–$C_4$alkoxy, sulfo, nitro or halogen.

The radicals D and D′ may be derived, for example, from the following compounds: anthranilic acid, 4- or 5-sulfo-2-aminophenol, 4- or 5-nitro-2-aminophenol, 4-nitro-6-sulfo-2-aminophenyl, 6-nitro-4-sulfo-2-aminophenol, 4-chloro-5-nitro-2-aminophenol, 4-methyl-2-aminophenol, 6-chloro-4-sulfo-2-aminophenol, 4-chloro-6-sulfo-2-aminophenyl, 4-chloro- or 4-methyl-6-nitro-2-aminophenol, 4-chloro-2-aminophenol, 4-methylsulfonyl-2-aminophenol, 4-(2-methoxyphenylazo)-2-aminophenol, 4-(2-, 3- or 4-sulfophenylazo)-2-aminophenol, 4-phenylazo-2-aminophenol, 1-amino-2-hydroxynaphthalene-4-sulfonic acid, 1-amino-2-hydroxy-6-nitronaphthalene-4-sulfonic acid.

Most preferably, D and D′ are each independently of the other the radical of a 2-aminophenol which is unsubstituted or substituted by one or more identical or different members selected from the group consisting of nitro, sulfo, chloro, methyl, methoxy, methylsulfonyl and phenylazo which may itself be substituted in the phenyl moiety by sulfo, methyl, methoxy, nitro or chloro, or are the radical of a 1-amino-2-hydroxynaphthalene which may be substituted by sulfo and/or nitro.

K and K′ may be a phenol or 1- or 2-naphthol radical which is unsubstituted or substituted, for example, by amino, hydroxy, $C_1$–$C_4$alkoxy, $C_1$–$C_4$alkyl, $C_1$–$C_4$alkanoylamino, for example acetylamino or benzoylamino, sulfo, halogen or phenylazo which may itself be substituted in the phenyl moiety by $C_1$–$C_4$alkyl, $C_1$–$C_4$alkoxy, sulfo, nitro or halogen.

Illustrative of suitable coupling components from which the radicals K and K′ may be derived are: 1-naphthol, 2-naphthol, 1,3- or 1,5-dihydroxynaphthalene, 2-hydroxy-8-acetylaminonaphthalene, 2-naphthol-3-, -4-, -5-, -6-, -7- or -8-sulfonic acid, resorcinol, 3-dimethylaminophenol or 3-diethylaminophenol, phenylazoresorcinol, o-, m- or p-chlorophenylazoresorcinol, bis(o-, m- or p-chlorophenylazo)resorcinol.

Preferably K and K′ are each independently of the other a 1- or 2-naphthol radical which is unsubstituted or substituted by hydroxy, amino, sulfo or acetylamino, or are an unsubstituted resorcinol radical or a resorcinol radical which is substituted by phenylazo which may itself be substituted in the phenyl moiety by methyl, methoxy, chloro, sulfo or nitro.

The complex dyes of formula (2) contain, for example, 0 to 4, preferably 1 to 4 and, most preferably, 1 or 2 sulfo groups.

Particularly preferred complex dyes for use in the process of this invention are black complex dyes which are in the form of the free acid of formula

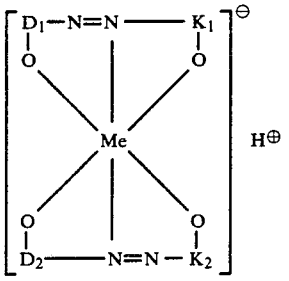

(2a)

wherein $D_1$ and $D_2$ are each independently of the other the radical of a 1-amino-2-hydroxynaphthalene which is unsubstituted or substituted by sulfo and/or nitro, or are the radical of a 2-aminophenol which is unsubstituted or substituted by nitro, sulfo, chloro, methyl, methoxy, methylsulfonyl or phenylazo which may itself be substituted in the phenyl moiety by sulfo, methyl, methoxy, nitro or chloro, and $K_1$ and $K_2$ are each independently of the other a 1- or 2-naphthol radical which is unsubstituted or substituted by hydroxy, amino, sulfo or acetylamino, or are a resorcinol radical which is unsubstituted or substituted by phenylazo which may itself be substituted in the phenyl moiety by methyl, methoxy, chloro, sulfo or nitro, and wherein the complex dye contains one or two sulfo groups.

Illustrative of preferred black complex dyes are:

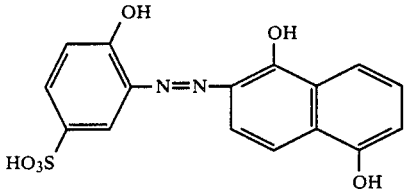

1:2 chromium complex

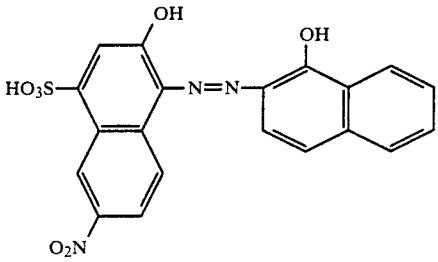

1:2 chromium complex

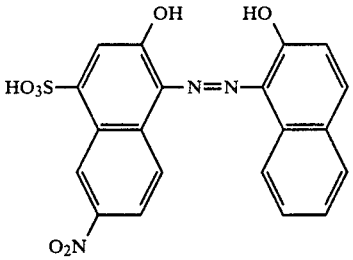

1:2 chromium complex

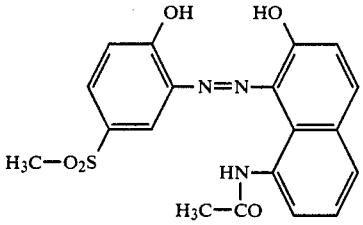

1:2 chromium complex

-continued
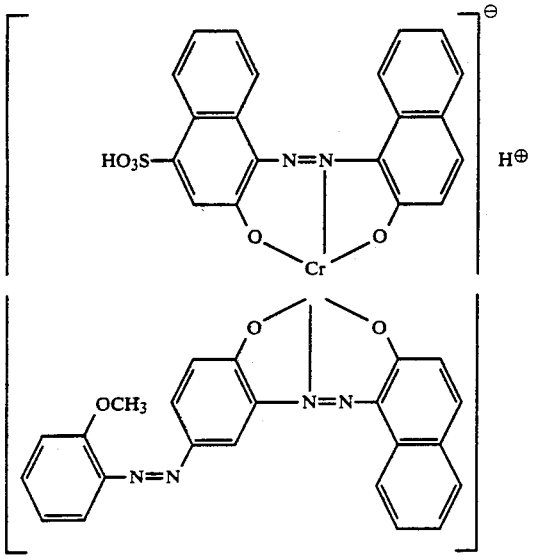
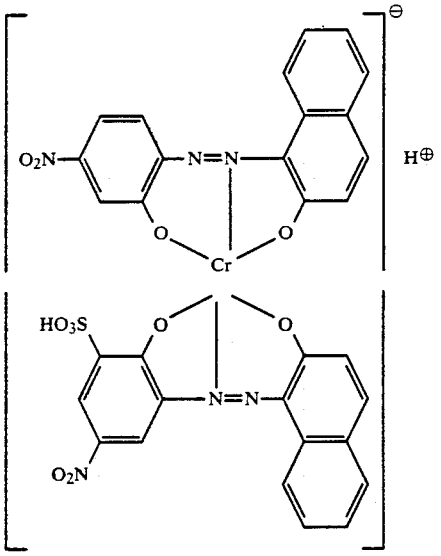
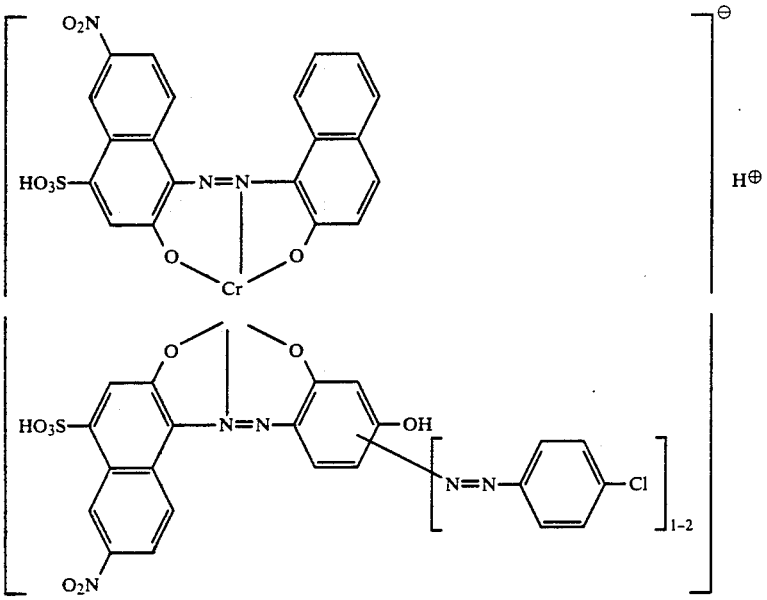

The metal complex compounds of formula (2), which are conveniently used in the form of their salts, preferably alkali metal salts such as lithium, potassium and, most preferably, sodium salts or also ammonium salts, are known per se or can be obtained in a manner which is known per se.

The pigment suitable for use in the process of this invention may be selected from any of the customary inorganic white, black and coloured pigments known, for example, from Kirk-Othmer, Encyclopedia of Chemical Technology, Vol. 17, pp. 788–838, John Wiley 1982.

Illustrative of such pigments are: titanium dioxide, zinc oxide, barium sulfate, silicon dioxide [white]; chrome green ($Cr_2O_3$) [green]; cobalt blue ($CoOAl_2O_3$), ultramarine blue ($Na_{(6-8)}Al_6Si_6O_{24}S_{(2-4)}$), Prussian blue ($FeNH_4Fe(CN)_6$) [blue]; natural and synthetic iron oxides, for example Siena brown, iron black ($Fe_3O_4$); carbon black [black].

The use of black pigments is preferred, especially carbon black, all types of which are suitable.

The pigments have an average particle size of typically 0.01 to 100 μm, preferably 0.01 to 1 μm, and, most preferably, 0.015 to 0.5 μm.

A carbon black used as pigment will preferably have an average particle size of 10 to 100 nm, most preferably of 20 to 50 nm.

The formulations used in the process of this invention preferably contain the anionic dye and the pigment in a weight ratio of typically 95:5 to 50:50, preferably 90:10 to 60:40 and, most preferably, 80:20 to 70:30. It is also possible to use formulations of different anionic dyes and/or pigments. The formulations may additionally contain a dust inhibitor, for example a dust oil.

In the process of this invention it is preferred to use formulations of a black anionic dye and a black inorganic pigment.

Particularly preferred formulations are those which contain a black dye of formula (1) or (2) above, and a carbon black pigment.

A particularly preferred embodiment of the process of this invention comprises using a formulation which contains a black anionic dye of formula (1a) or (2a) as indicated above and a carbon black pigment, in the weight ratio of 90:10 to 60:40 and, preferably, of 80:20 to 70:30.

The above formulations, which consist substantially of an anionic dye and an inorganic pigment, are novel and likewise constitute an object of this invention. They can be prepared, for example, by mechanically mixing the components in a suitable mixing device, for example a ball or pin mill, or in a kneader or mixer.

The process of this invention is conveniently carried out such that the leather to be dyed is first subjected to a pretreatment, for example a retanning, neutralising and/or fulling process.

The pretreated leather is then dyed by a known exhaust process using one of the dye formulations described above. For example, the leather is dyed in an aqueous solution at a liquor ratio of 1:1.5 to 1:20, preferably of 1:2 to 1:10, and at a temperature in the range from, for example, 20° to 100° C., preferably 40° to 60° C. Depending on the type of leather to be dyed, 0.25 to 15.0% by weight, preferably 1.0 to 10.0% by weight, of the respective dye formulation, based on the weight of the leather, will be used. The dyeing time will also depend on the type of the leather to be dyed, but is normally, for example, from 20 to 180 minutes.

Before, during or after dyeing, further conventional auxiliaries such as wetting agents, levelling agents, colour intensifiers and/or fatliquoring agents can be added to the dyebath. At the end of the dyeing procedure, acidification will conveniently be effected with, for example, formic acid for better bath exhaustion, and the liquor is allowed to continue circulating for a time. The dyed leather is finished in a manner which is known per se.

The dyeing process of this invention is suitable for all types of leather, for example grained and rough grained leather, chrome leather, retanned leather or suede leather made from goatskin, sheepskin, cowhide and pigskin. Level, deep dyeings of good opacity and good allround fastness properties such as fastness to water, washing, perspiration, dry cleaning, acid, alkali, solvents and diffusion resistance to soft PVC are obtained. The outstanding lightfastness of the dyeings obtainable by the process of this invention merits special mention, as does also the dye penetration of the leather.

The invention is illustrated by the following non-limitative Examples in which parts and percentages are by weight.

EXAMPLES 1–16

100 parts of sheepskin nappa leather, which have been subjected to an intermediate drying, are pretreated for 60 minutes at 50° C. in a liquor prepared from 1000 parts of water, 2 parts of a nonionic wetting agent (polyethylene glycol ether derivative) and 1 part of 24% ammonia, and then thoroughly rinsed.

The pretreated leather is subsequently dyed for 30 minutes at 50° C. in a fresh liquor consisting of 500 parts of water and 5 parts of one of the dye formulations listed in the Table. Then 8 parts of a fatliquoring agent consisting of 2 parts of sulfonated marine animal oil, 2 parts of a mixture of sulfonated fatty acid esters and animal fats, and 4 parts of a mixture of sulfonated natural oils and animal fats are added. After a further 60 minutes, the bath is acidified with 4 parts of 85% formic acid (pH ca. 3.2) and the treatment is continued for 20 minutes. Then 2 parts of a cationic colour intensifier (polyquaternary amine/ethylene oxide adduct) are added and the liquor is allowed to continue circulating for another 20 minutes.

Dyeing is again carried out for 30 minutes at 50° C. in a fresh bath with 5 parts of the above dye formulation in 500 parts of water. To the dyebath are then added 3 parts of a nonionic synthetic fatliquoring agent (fatty acid/polyamide condensate) and, after a further 20 minutes, 1 part of 85% formic acid. After a final treatment time of 20 minutes, the leather is rinsed and finished in conventional manner. Level, deep dyeings of good allround fastness properties are obtained.

TABLE

| Example | Dye formulation Anion dye | Pigment | Weight ratio of dye/pigment |
|---|---|---|---|
| 1 | 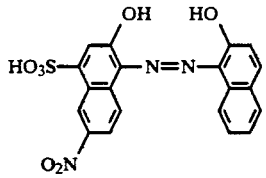 1:2 - Cr-complex | carbon black ASTM Specification N 330 (average particle size 26–30 nm) | 80:20 |
| 2 | 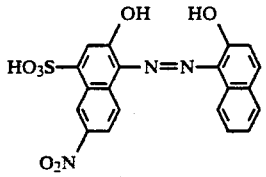 1:2 - Cr-complex | carbon black ASTM Specification N 330 (average particle size 26–30 nm) | 70:30 |
| 3 | 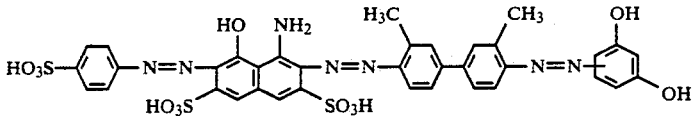 | carbon black ASTM Specification N 330 (average particle size 26–30 nm) | 80:20 |
| 4 | 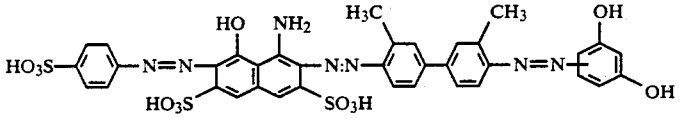 | carbon black ASTM Specification N 330 (average particle size 26–30 nm) | 70:30 |
| 5 | 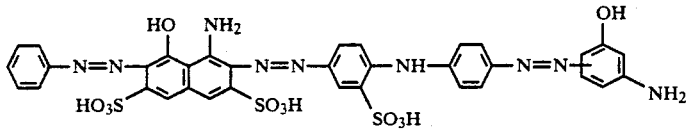 | carbon black ASTM Specification N 330 (average particle size 26–30 nm) | 60:40 |
| 6 | 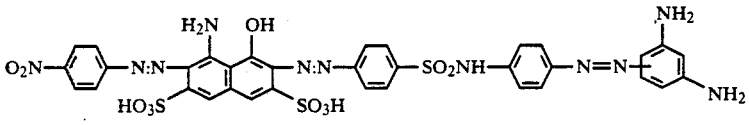 | carbon black ASTM Specification N 330 (average particle size 26–30 nm) | 80:20 |
| 7 | 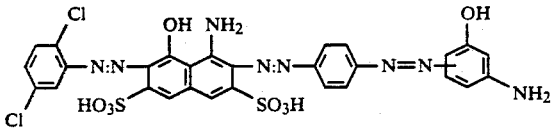 | carbon black ASTM Specification N 330 (average particle size 26–30 nm) | 70:30 |
| 8 | 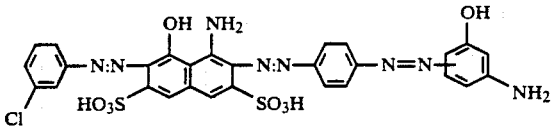 | carbon black ASTM Specification N 330 (average particle size 26–30 nm) | 70:30 |
| 9 | 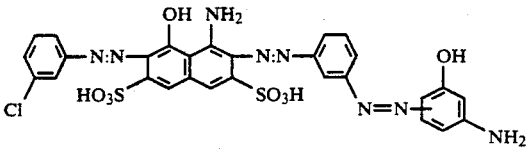 | carbon black ASTM Specification N 330 (average particle size 26–30 nm) | 80:20 |
| 10 | 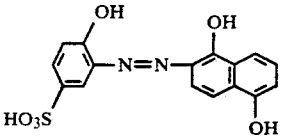 1:2 chromium complex | carbon black ASTM Specification N 220 (average particle size 20–25 nm) | 90:10 |

TABLE-continued

| Example | Dye formulation Anion dye | Pigment | Weight ratio of dye/pigment |
|---|---|---|---|
| 11 | 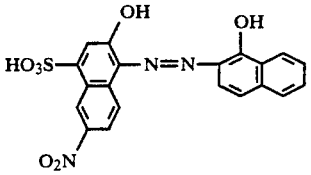 1:2 chromium complex | carbon black ASTM Specification N 220 (average particle size 20–25 nm) | 80:20 |
| 12 | 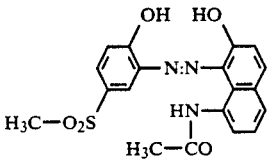 1:2 - chromium complex | carbon black ASTM Specification N 330 (average particle size 26–30 nm) | 80:20 |
| 13 | 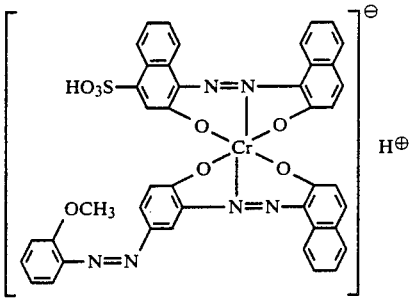 | carbon black ASTM Specification N 330 (average particle size 26–30 nm) | 80:20 |
| 14 | 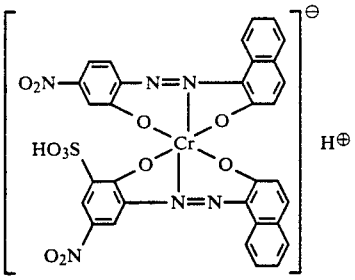 | carbon black ASTM Specification N 330 (average particle size 26–30 nm) | 80:20 |
| 15 | 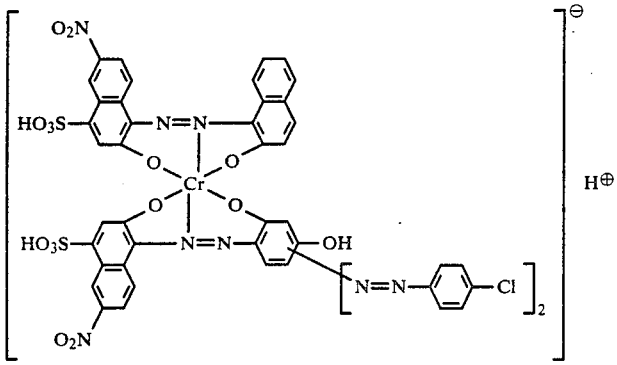 | carbon black ASTM Specification N 330 (average particle size 26–30 nm) | 90:10 |

TABLE-continued

| Example | Dye formulation Anion dye | Pigment | Weight ratio of dye/pigment |
|---|---|---|---|
| 16 | 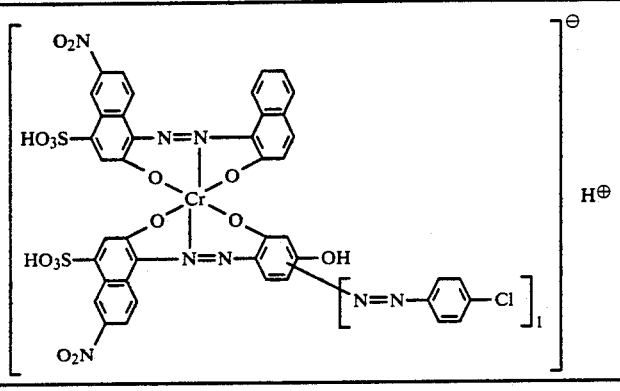 | carbon black ASTM Specification N 330 (average particle size 26–30 nm) | 80:20 |

The formulations used in Examples 1 to 16 are obtained by simple mixing of the components in a mixer.

EXAMPLE 17

100 parts of chrome side leather are wetted back for 15 minutes at 30° C. in a liquor consisting of 200 parts of water, 1 part of sodium formiate and 2 parts of a synthetic re-tanning substance (sodium salts of aromatic sulfonic acids and aliphatic dicarbonic acids). Then 2 parts of an anionic fatliquoring agent (sulfonated marine animal oil), 2 parts of an anionic re-tanning agent (condensation product of aromatic sulfonic acids) and 1.5 parts of sodium bicarbonate are added and the liquor is allowed to continue circulating for another 60 minutes.

The leather is thoroughly rinsed with warm water and is then re-tanned for 30 minutes at 40° C. in a fresh liquor consisting of 100 parts of water and 8 parts of an anionic re-tanning agent (condensation product of aromatic sulfone derivatives and dialkylol carbamide). Then 5 parts of the above mentioned anionic fatliquoring agent are added, followed after a further 60 minutes by 0.5 parts of 85% formic acid. After acidification, the treatment is continued for a further 15 minutes.

The pretreated leather is subsequently dyed for 30 minutes at 30° C. in a fresh liquor consisting of 100 parts of water, 0.5 parts of ammonia, 1 part of a levelling agent (polyglycol ether derivative) and 2.65 parts of the dye formulation of Example 2. Then 8 parts of the above mentioned fatliquoring agent and 4 parts of a hydrophobing agent are added. After a further 60 minutes, the bath is acidified with 2.5 parts of 85% formic acid and the treatment is continued for 30 minutes.

Dyeing is again carried out for 30 minutes at 50° C. in a fresh bath with 1.35 parts of the above dye formulation and 0.5 parts of a cationic colour intensifier (polyquaternary amine/ethylene oxide adduct) in 200 parts of water. To the dyebath are then added 1 part of 85% formic acid and, after a further 15 minutes, 1.5 parts of a cationic fatliquoring agent (preparation based on chlorinated hydrocarbons and n-alkyl derivatives). After a final treatment time of 20 minutes, the leather is rinsed and finished in conventional manner. Level deep dyeings of good allround fastness properties are obtained.

What is claimed is:

1. A process for dyeing leather, which comprises treating leather by the exhaust process with an aqueous liquor which contains a formulation consisting essentially of a black anionic dye selected from the group consisting of acid dyes, direct dyes and metal complex dyes and a carbon black pigment; the weight ratio of anionic dye to black pigment being from 95:5 to 50:50.

2. A process according to claim 1, wherein the anionic dye is a dye of formula

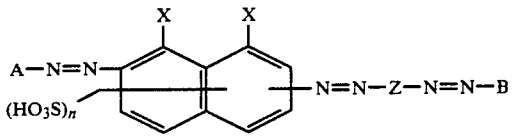

(1)

wherein one X is hydroxy and the other X is amino or hydrogen, A is phenyl or naphthyl each unsubstituted or substituted by $C_1$–$C_4$alkyl, $C_1$–$C_4$alkoxy, halogen, trifluoromethyl, $C_1$–$C_4$alkylsulfonyl, sulfamoyl, N-mono- or N,N-di-$C_1$–$C_4$-alkylsulfamoyl, carbamoyl, N-mono- or N,N-di-$C_1$–$C_4$-alkylcarbamoyl, sulfo, nitro, cyano, carboxy or phenoxy, B is a phenyl or naphthyl each containing at least one amino or hydroxy group and carrying no further substituents or carrying further substituents selected from the group consisting of N-mono- or N,N-di-$C_1$–$C_4$-alkylamino, phenylamino, o-, m- or p-methylphenylamino, unsubstituted or methyl-, chloro- or nitro-substituted benzoylamino, $C_1$–$C_4$alkanoylamino or carboxymethylamino and the substituents cited previously for A, Z is a radical of formula

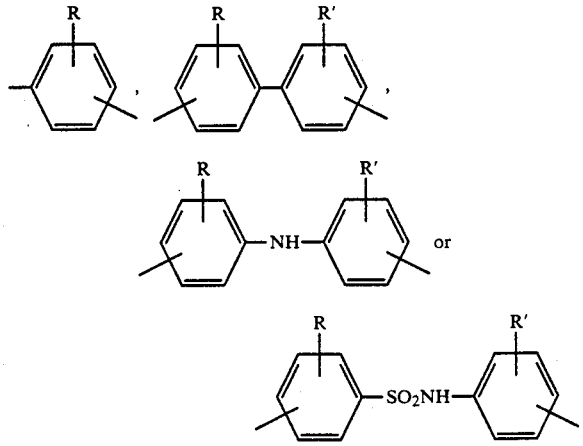

and R and R' are each independently of the other hydrogen, sulfo, $C_1$–$C_4$alkyl or $C_1$–$C_4$alkoxy, and n is 1 or 2.

3. A process according to claim 1, wherein the anionic dye is a dye of formula

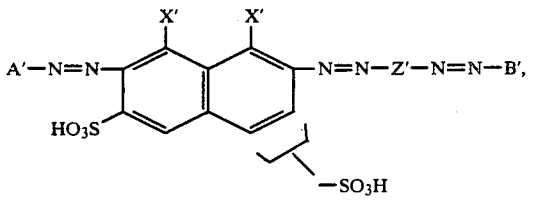

(1a)

wherein A' is phenyl or phenyl which is substituted by halogen, nitro, sulfo, $C_1$–$C_4$alkyl or $C_1$–$C_4$alkoxy, B' is phenyl which carries a hydroxyl or amino group and a further substituent selected from the group consisting of hydroxy, amino, phenylamino, o-, m- or p-methylphenylamino, $C_1$–$C_4$alkoxy and phenoxy, Z' is a radical of formula

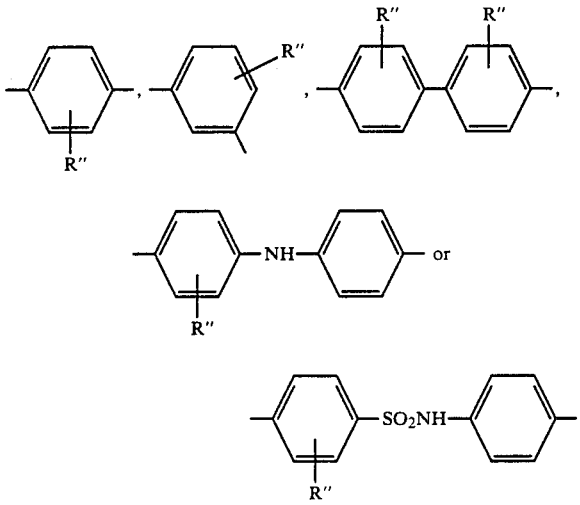

wherein R'' is hydrogen, methyl, methoxy or sulfo, and one X' is hydroxy and the other X' is amino.

4. A process according to claim 1, wherein the anionic dye is in the form of the free acid of formula

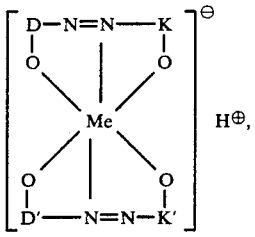

(2)

wherein D and D' are each independently of the other a benzene or naphthalene radical which carries a hydroxyl group ortho to the azo group and which is further unsubstituted or is substituted by sulfo, nitro, $C_1$–$C_4$alkylsulfonyl, $C_1$–$C_4$alkyl, halogen or unsubstituted or $C_1$–$C_4$alkyl-, $C_1$–$C_4$alkoxy-, sulfo-, nitro- or halogen-substituted phenylazo, K and K' are each independently of the other a coupling component benzene or naphthalene radical which carries a hydroxyl group ortho to the azo group and which is further unsubstituted or substituted by amino, hydroxy, $C_1$–$C_4$alkoxy, $C_1$–$C_4$alkyl, $C_1$–$C_4$alkanoylamino, benzoylamino, sulfo, halogen or unsubstituted or $C_1$–$C_4$alkyl-, $C_1$–$C_4$alkoxy-, sulfo-, nitro-or halogen-substituted phenylazo, and Me is chromium or cobalt.

5. A process according to claim 1, wherein the anionic dye is a dye of formula

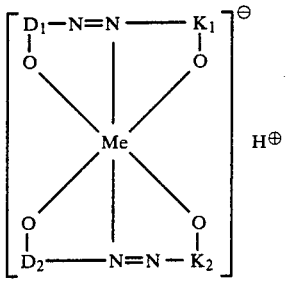

(2a)

wherein $D_1$ and $D_2$ are each independently of the other the radical of a 1-amino-2-hydroxynaphthalene which is unsubstituted or substituted by sulfo and/or nitro, or are the radical of a 2-aminophenol which is unsubstituted or substituted by nitro, sulfo, chloro, methyl, methoxy, methylsulfonyl or phenylazo which may itself be substituted in the phenyl moiety by sulfo, methyl, methoxy, nitro or chloro, and $K_1$ and $K_2$ are each independently of the other a 1- or 2-naphthol radical which is unsubstituted or substituted by hydroxy, amino, sulfo or acetylamino, or are a resorcinol radical which is unsubstituted or substituted by phenylazo which may itself be substituted in the phenyl moiety by methyl, methoxy, chloro, sulfo or nitro, and wherein the complex dye contains one or two sulfo groups.

6. A process according to claim 1, wherein the formulation contains a black anionic dye of formula

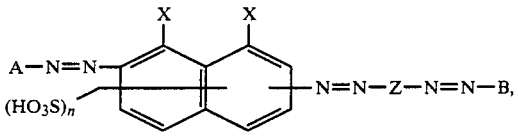

(1)

wherein one X is hydroxy and the other X is amino or hydrogen, A is phenyl or naphthyl each unsubstituted or substituted by $C_1$–$C_4$alkyl, $C_1$–$C_4$alkoxy, halogen, trifluoromethyl, $C_1$–$C_4$alkylsulfonyl, sulfamoyl, N-mono- or N,N-di-$C_1$–$C_4$-alkylsulfamoyl, carbamoyl, N-mono- or N,N-di-$C_1$–$C_4$-alkylcarbamoyl, sulfo, nitro, cyano, carboxy or phenoxy, B is a phenyl or naphthyl each containing at least one amino or hydroxy group and carrying no further substituents or carrying further substituents selected from the group consisting of N-mono- or N,N-di-$C_1$–$C_4$-alkylamino, phenylamino, o-, m- or p-methylphenylamino, unsubstituted or methyl-, chloro- or nitro-substituted benzoylamino, $C_1$–$C_4$alkanoylamino or carboxymethylamino and the substituents cited previously for A, Z is a radical of formula

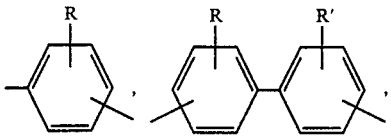

-continued

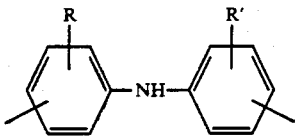

or

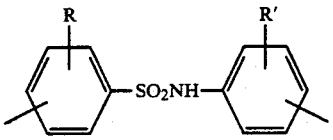

and R and R' are each independently of the other hydrogen, sulfo, $C_1$–$C_4$alkyl or $C_1$–$C_4$alkoxy, and n is 1 or 2, or a black anionic dye of formula

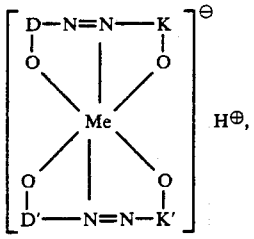

(2)

wherein D and D' are each independently of the other a benzene or naphthalene radical which carries a hydroxyl group ortho to the azo group and which is further unsubstituted or is substituted by sulfo, nitro, $C_1$–$C_4$alkylsulfonyl, $C_1$–$C_4$alkyl, halogen or unsubstituted or $C_1$–$C_4$alkyl-, $C_1$–$C_4$alkoxy-, sulfo-, nitro- or halogen-substituted phenylazo, K and K' are each independently of the other a coupling component benzene or naphthalene radical which carries a hydroxyl group ortho to the azo group and which is further unsubstituted or substituted by amino, hydroxy, $C_1$–$C_4$alkoxy, $C_1$–$C_4$alkyl, $C_1$–$C_4$alkanoylamino, benzoylamino, sulfo, halogen or unsubstituted or $C_1$–$C_4$alkyl-, $C_1$–$C_4$alkoxy-, sulfo-, nitro-or halogen-substituted phenylazo, and Me is chromium or cobalt, and a carbon black pigment.

7. A process according to claim 1, wherein the formulation contains a black anionic dye of formula

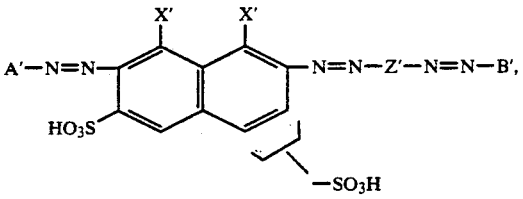

(1a)

wherein A' is phenyl or phenyl which is substituted by halogen, nitro, sulfo, $C_1$–$C_4$alkyl or $C_1$–$C_4$alkoxy, B' is phenyl which carries a hydroxyl or amino group and a further substituent selected from the group consisting of hydroxy, amino, phenylamino, o-, m- or p-methylphenylamino, $C_1$–$C_4$alkoxy and phenoxy, Z' is a radical of formula

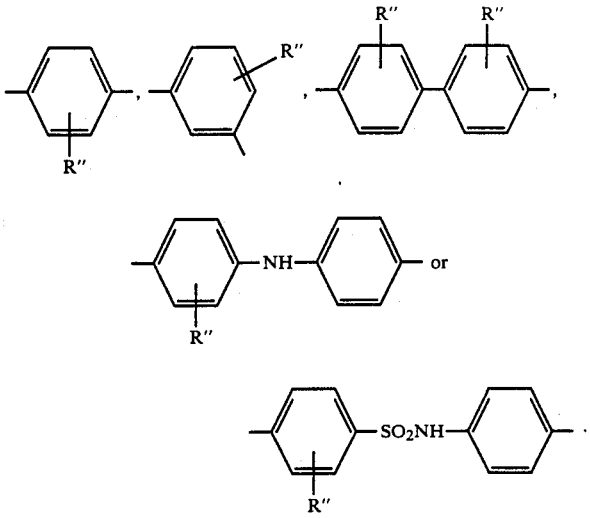

wherein R'' is hydrogen, methyl, methoxy or sulfo, and one X' is hydroxy and the other X' is amino, or a black anionic dye of formula

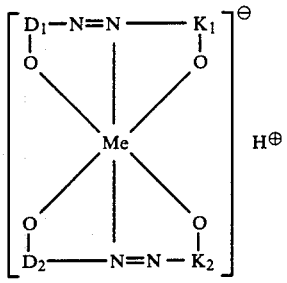

(2a)

wherein $D_1$ and $D_2$ are each independently of the other the radical of a 1-amino-2-hydroxynaphthalene which is unsubstituted or substituted by sulfo or nitro, or are the radical of a 2-aminophenol which is unsubstituted or substituted by nitro, sulfo, chloro, methyl, methoxy, methylsulfonyl or phenylazo which may itself be substituted in the phenyl moiety by sulfo, methyl, methoxy, nitro or chloro, and $K_1$ and $K_2$ are each independently of the other a 1- or 2-naphthol radical which is unsubstituted or substituted by hydroxy, amino, sulfo or acetylamino, or are a resorcinol radical which is unsubstituted or substituted by phenylazo which may itself be substituted in the phenyl moiety by methyl, methoxy, chloro, sulfo or nitro, and wherein the complex dye contains one or two sulfo groups, and a carbon black pigment, in the weight ratio of 90:10 to 60:40.

8. A process according to claim 1, wherein the carbon black pigment has an average particle size of 10 to 100 nm.

9. A process according to claim 1, wherein the formulation contains the anionic dye and the pigment in a weight ratio of 90:10 to 60:40.

10. A process according to claim 8, wherein the carbon black pigment has an average particle size of 20 to 50 nm.

11. A process according to claim 9, wherein the formulation contains the black anionic dye and the carbon black pigment in the weight ratio of 90:10 to 70:30.

12. A process of claim 7 wherein the formulation contains the black anionic dye and the carbon black pigment in the weight ratio of 90:10 to 70:30.

13. A dye formulation consisting essentially of a black anionic dye selected from the group consisting of acid dyes, direct dyes and metal complex dyes and a carbon black pigment in a weight ratio of 95:5 to 50:50.

14. A dye formulation according to claim 13 wherein the black anionic dye is of the formula

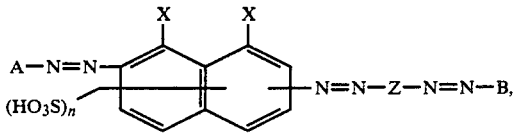

(1)

wherein one X is hydroxy and the other X is amino or hydrogen, A is phenyl or naphthyl each unsubstituted or substituted by $C_1$–$C_4$alkyl, $C_1$–$C_4$alkoxy, halogen, trifluoromethyl, $C_1$–$C_4$alkylsulfonyl, sulfamoyl, N-mono- or N,N-di-$C_1$–$C_4$-alkylsulfamoyl, carbamoyl, N,N-di-$C_1$–$C_4$-alkylcarbamoyl, sulfo, nitro, cyano, carboxy or phenoxy, B is a phenyl or naphthyl each containing at least one amino or hydroxy group and carrying no further substituents or carrying further substituents selected from the group consisting of N-mono-or N,N-di-$C_1$–$C_4$-alkylamino, phenylamino, o-, m- or p-methylphenylamino, unsubstituted or methyl-, chloro- or nitro-substituted benzoylamino, $C_1$–$C_4$alkanoylamino or carboxymethylamino and the substituents cited previously for A, Z is a radical of formula

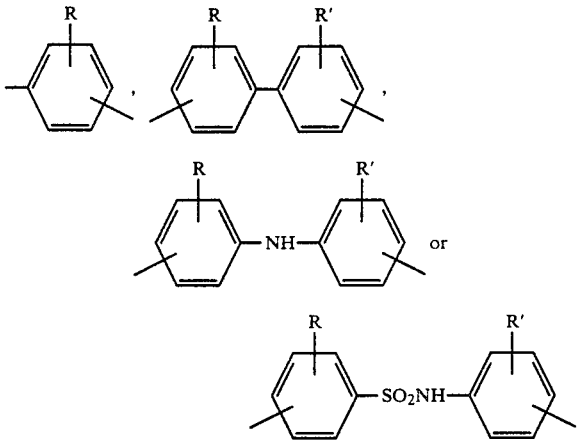

and R and R′ are each independently of the other hydrogen, sulfo, $C_1$–$C_4$alkyl or $C_1$–$C_4$alkoxy, and n is 1 or 2, or a black anionic dye of formula

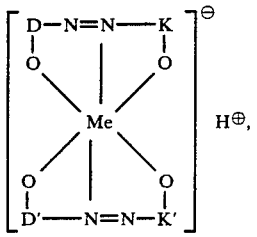

(2)

wherein D and D′ are each independently of the other a benzene or naphthalene radical which carries a hydroxyl group ortho to the azo group and which is further unsubstituted or is substituted by sulfo, nitro, $C_1$–$C_4$alkylsulfonyl, $C_1$–$C_4$alkyl, halogen or unsubstituted or $C_1$–$C_4$alkyl-, $C_1$–$C_4$alkoxy-, sulfo-, nitro- or halogen-substituted phenylazo, K and K′ are each independently of the other a coupling component benzene or naphthalene radical which carries a hydroxyl group ortho to the azo group and which is further unsubstituted or substituted by amino, hydroxy, $C_1$–$C_4$alkoxy, $C_1$–$C_4$alkyl, $C_1$–$C_4$alkanoylamino, benzoylamino, sulfo, halogen or unsubstituted or $C_1$–$C_4$alkyl-, $C_1$–$C_4$alkoxy-, sulfo-, nitro-or halogen-substituted phenylazo, and Me is chromium or cobalt, and a carbon black pigment.

15. A dye formulation according to claim 13 wherein the black anionic dye is of the formula

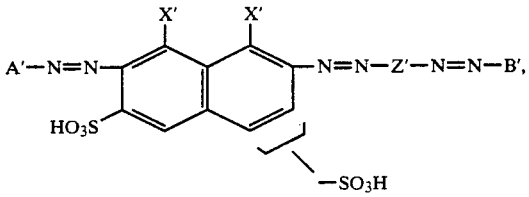

(1a)

wherein A′ is phenyl or phenyl which is substituted by halogen, nitro, sulfo, $C_1$–$C_4$alkyl or $C_1$–$C_4$alkoxy, B′ is phenyl which carries a hydroxyl or amino group and a further substituent selected from the group consisting of hydroxy, amino, phenylamino, o-, m- or p-methylphenylamino, $C_1$–$C_4$alkoxy and phenoxy, Z′ is a radical of formula

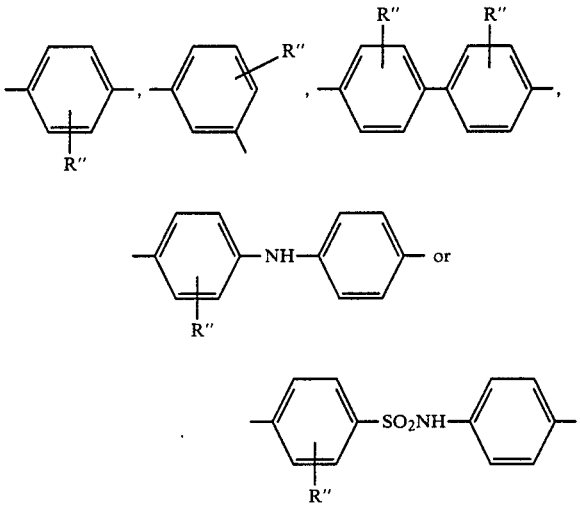

wherein R″ is hydrogen, methyl, methoxy or sulfo, and one X′ is hydroxy and the other X′ is amino, or a black anionic dye of formula

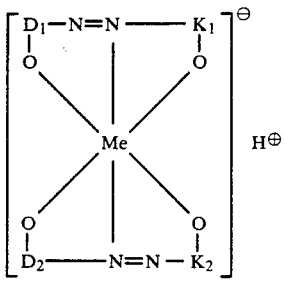

(2a)

wherein $D_1$ and $D_2$ are each independently of the other the radical of a 1-amino-2-hydroxynaphthalene which is unsubstituted or substituted by sulfo or nitro, or are the radical of a 2-aminophenol which is unsubstituted or substituted by nitro, sulfo, chloro, methyl, methoxy, methylsulfonyl or phenylazo which may itself be substituted in the phenyl moiety by sulfo, methyl, methoxy, nitro or chloro, and $K_1$ and $K_2$ are each independently of the other a 1- or 2-naphthol radical which is unsubstituted or substituted by hydroxy, amino, sulfo or acetylamino, or are a resorcinol radical which is unsubstituted or substituted by phenylazo which may itself be substituted in the phenyl moiety by methyl, methoxy, chloro, sulfo or nitro, and wherein the complex dye contains one or two sulfo groups, and a carbon black pigment, in the weight ratio of 90:10 to 60:40.

16. A dye formulation according to claim 13, which contains the black anionic dye and the carbon black pigment in the weight ratio of 80:20 to 70:30.

* * * * *